US011821230B2

(12) United States Patent
Bucarizza

(10) Patent No.: US 11,821,230 B2
(45) Date of Patent: Nov. 21, 2023

(54) GRID STRUCTURE

(71) Applicant: COCHRANE INDUSTRIES UK LIMITED, Worcester (GB)

(72) Inventor: Vlado Bucarizza, Dubai (AE)

(73) Assignee: COCHRANE INDUSTRIES UK LIMITED, Worcester (GB)

( * ) Notice: Subject to any disclaimer, the term of this patent is extended or adjusted under 35 U.S.C. 154(b) by 93 days.

(21) Appl. No.: 17/616,272

(22) PCT Filed: Jun. 4, 2020

(86) PCT No.: PCT/IB2020/055259
§ 371 (c)(1),
(2) Date: Dec. 3, 2021

(87) PCT Pub. No.: WO2020/245753
PCT Pub. Date: Dec. 10, 2020

(65) Prior Publication Data

US 2022/0316232 A1 Oct. 6, 2022

(30) Foreign Application Priority Data

Jun. 4, 2019 (ZA) ..... 2019/03565

(51) Int. Cl.
*E04H 17/14* (2006.01)

(52) U.S. Cl.
CPC ..... *E04H 17/1439* (2013.01)

(58) Field of Classification Search
CPC . E04H 17/14; E04H 17/1421; E04H 17/1426; E04H 17/1439; E04H 17/1443; E04H 17/1478; E04H 17/16
USPC ..... 256/22, 59, 65.01, 65.02, 65.08, 65.12
See application file for complete search history.

(56) References Cited

U.S. PATENT DOCUMENTS 4,667,935 A * 5/1987 Moore ..... E04F 11/181 256/22
5,372,354 A * 12/1994 Cacicedo ..... E04H 17/1439 256/22
6,131,888 A * 10/2000 Brown ..... E04H 17/1439 256/65.03
7,021,607 B1 * 4/2006 Alexander ..... E04H 17/1439 256/70
7,032,890 B2 * 4/2006 Svalbe ..... E04H 17/1439 256/65.01
9,212,504 B1 * 12/2015 Mobile, Sr. ..... E04H 17/12
2003/0201432 A1 * 10/2003 Norman ..... E04F 11/1817 256/65.08

(Continued)

FOREIGN PATENT DOCUMENTS

GB 2436808 A 10/2007

OTHER PUBLICATIONS

International Search Report and Written Opinion for Application No. PCT/IB2020/055259 dated Sep. 28, 2020 (10 pages).

*Primary Examiner* — Daniel J Wiley
(74) *Attorney, Agent, or Firm* — MICHAEL BEST & FRIEDRICH LLP

(57) ABSTRACT

A security grid structure comprising two spaced elongate channel sections with side walls which are formed with spaced apart apertures, and elongate members each of which extends through associated apertures in the side walls, and at least one elongate element which extends transversely to, and which is secured to, the elongate members.

11 Claims, 4 Drawing Sheets

(56) References Cited

U.S. PATENT DOCUMENTS

| | | | | |
|---|---|---|---|---|
| 2004/0164287 | A1* | 8/2004 | Svalbe | E04H 17/1439 256/65.08 |
| 2005/0236611 | A1* | 10/2005 | Vereide | E04F 11/1817 256/59 |
| 2006/0226407 | A1* | 10/2006 | Auret | E04F 11/1844 256/22 |
| 2010/0276653 | A1* | 11/2010 | Gibbs | E04H 17/1439 256/22 |
| 2016/0199880 | A1 | 7/2016 | George | |
| 2018/0274262 | A1 | 9/2018 | Walker et al. | |
| 2019/0145123 | A1 | 5/2019 | Lo | |

* cited by examiner

GRID STRUCTURE

CROSS REFERENCE TO RELATED APPLICATIONS

This application is a U.S. National phase application of International Application No. PCT/IB2020/055259 filed Jun. 4, 2020, which claims priority to Application No. ZA 2019/03565 filed Jun. 4, 2019, the entire contents of both of which are incorporated by reference herein.

BACKGROUND OF THE INVENTION

This invention relates to a grid structure for use in a protective barrier.

The incorporation of high density mesh panels in a fence leads to the establishment of an effective security barrier. Nonetheless certain applications require the security level to be enhanced. To meet this challenge a respective grid structure which is made from substantially more robust components than those included in the mesh panels can be installed adjacent each panel.

One type of grid structure which is employed includes a first plurality of parallel and spaced apart members which extend in a first direction and a second plurality of spaced apart and parallel members which extend in a second direction which is at a right angle to the first direction. The two sets of members are then welded to one another at respective points of contact and in this way a rigid assembly is fabricated. Although the end result has a significant security level the fabrication technique which is used in its manufacture calls for a substantial amount of welding. The welding is labour intensive and time consuming and, moreover, expensive.

A need exists for a grid structure which can be made in a more efficient manner.

SUMMARY OF THE INVENTION

The invention provides a security grid structure comprising a first elongate channel section which includes a first base and first and second opposed side walls, wherein the first side wall is formed with a plurality of spaced apart first apertures, a second elongate channel section which is spaced from and parallel to the first elongate channel section, the second elongate channel section including a second base and third and fourth opposed side walls, wherein each of the third and fourth side walls is formed with a plurality of spaced apart second apertures and wherein the second apertures in the third side wall are in register with respective second apertures in the fourth side wall, a plurality of elongate members which are parallel to and spaced apart from one another, each elongate member respectively including a first end and an opposed second end, wherein a portion of the elongate member at the first end extends through a respective first aperture in the first side wall of the first elongate channel section, and wherein the elongate member extends through a respective pair of registering second apertures in the second channel section and a part of the elongate member is positioned between opposing surfaces of the third and fourth side walls, and at least one elongate element which is positioned between the first and second elongate channel sections and which extends transversely to, and which is secured to, the elongate members.

The security grid structure may include at least two of the elongate elements referred to. Each elongate element may take on any suitable form but conveniently is a length of flat bar.

Each elongate element may be formed with a plurality of spaced apart holes, prior to inclusion of the elongate element in the security grid. The elongate element may then be positioned so that each hole in the elongate element is in register with a respective elongate member. This technique facilitates the securing of the elongate element to each elongate member in that, conveniently, the hole provides a means whereby the elongate element can be welded, e.g. puddle-welded, to the elongate member.

Each elongate member may have any appropriate cross section. In a preferred embodiment each elongate member is tubular and is square or rectangular in cross section.

To enhance the deterrent effect of each tubular member it may contain or be filled with attack-resistant material. In a preferred form of the invention each tubular member is filled with an ultrahard material. The ultrahard material may include a ceramic or similar composition. Preferably the ultrahard material is preformed, under factory conditions, into elongate, slender briquettes, each of a suitable length, which are then pushed into the interiors of the elongate members. A respective end cap may be engaged with the second end of each elongate member to ensure that the ultrahard briquettes are retained inside the elongate member.

The security grid structure may be one of a number of similar grid structures which are positioned side-by-side and which are interconnected to form a combined grid of an increased width. The combined grid may be positioned alongside a high density mesh panel in the construction of a security barrier.

BRIEF DESCRIPTION OF THE DRAWINGS

The invention is further described by way of example with reference to the accompanying drawings in which:

FIGS. 5A, 5B and 50 show on an enlarged scale details of construction of parts of the grid structure referring to FIGS. 3 and 4.

DESCRIPTION OF PREFERRED EMBODIMENT

Figure 1:
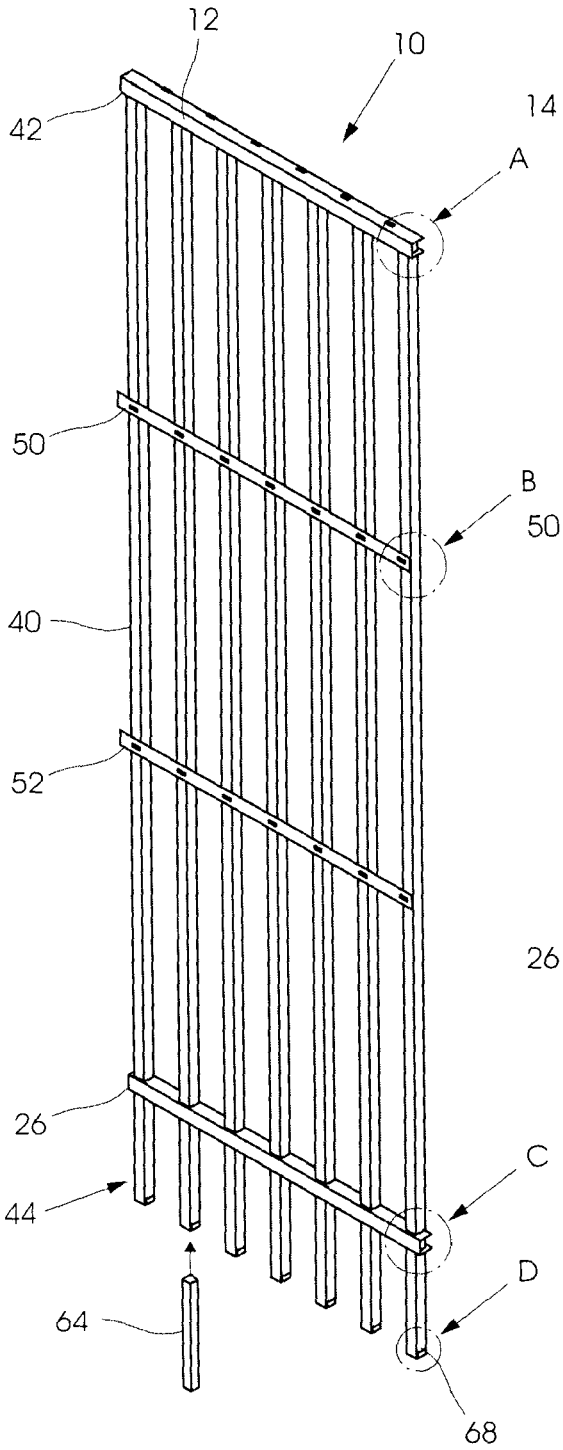
FIG. 1 is a view in perspective of a security grid structure according to the invention.
Figure 2A:
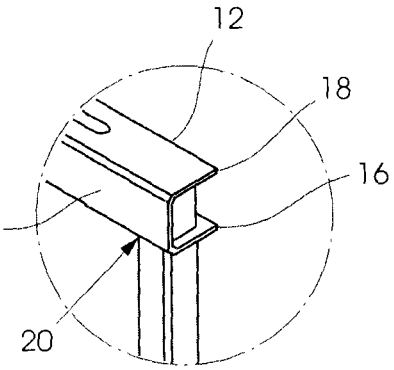
FIGS. 2A, 2B, 2C and 2D show details of construction, on an enlarged scale, of parts of the grid structure of FIG. 1.
Figure 2B:
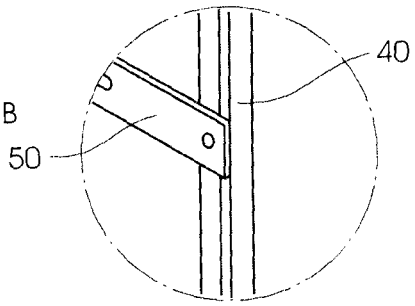
Figure 2C:
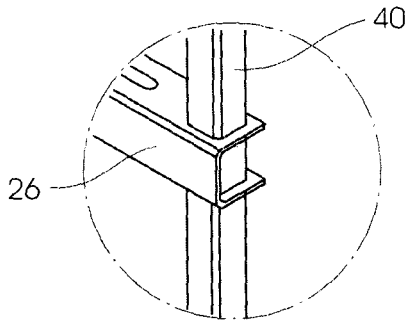
Figure 2D:
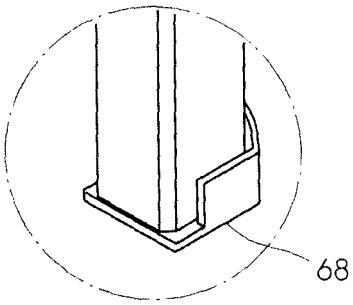
Figure 3:
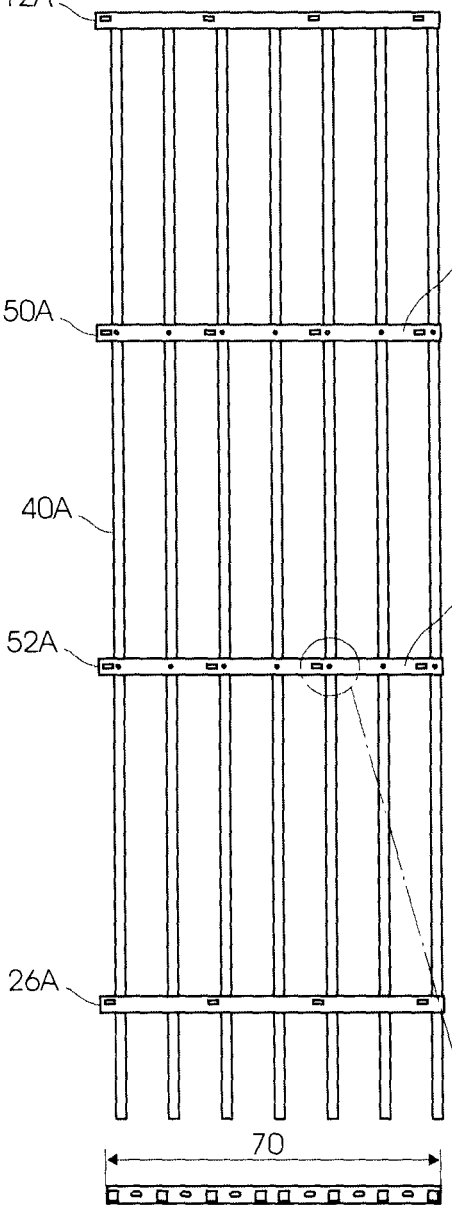
FIG. 3 is a view in elevation of the grid structure of FIG. 1.
Figure 4:
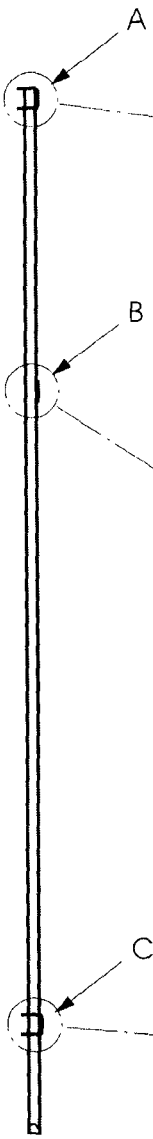
FIG. 4 is a side view of the grid structure.
Figure 5A:
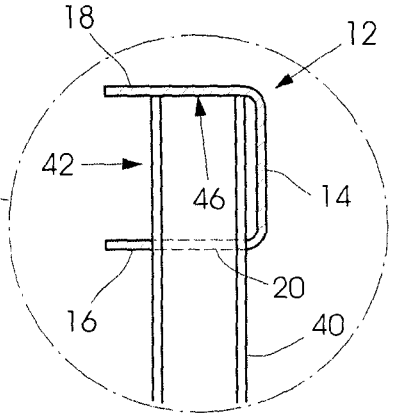
Figure 5B:
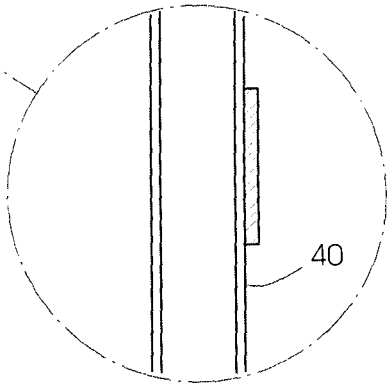
Figure 5C:
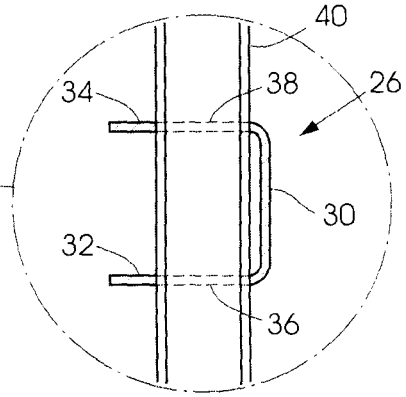

FIGS. 1, 3 and 4 are views in perspective, in elevation, and from one end, respectively, of a security grid structure 10 according to the invention. FIGS. 2A to 2D respectively illustrate on an enlarged scale portions of the grid structure designated in FIG. 1 by the letters A to D. FIGS. 5A, 5B and 5C similarly illustrate on an enlarged scale constructional details of the grid structure in FIGS. 3 and 4, designated with the letters A, B and C respectively.

The grid structure 10 includes a first upper elongate channel section 12 which has a base 14 and opposed first and second side walls 16 and 18 respectively—see FIG. 5A. The side wall 16 is formed with a plurality of spaced apart first apertures 20.

A second elongate channel section 26 is spaced from and is parallel to the first channel section 12 and is located at a lower end of the grid structure 10. The channel section 26 (see FIG. 5C) has a base 30 and opposed side walls 32 and 34. Registering sets of second apertures 36 and 38 are formed at spaced intervals in the side walls 32 and 34.

The grid structure 10 includes a plurality of spaced apart and parallel vertically extending elongate members 40 each of which is tubular in cross section and, preferably, of square cross section, with a first upper end 42 and a second lower end 44. The upper end 42 of each elongate member extends through a respective aperture 20 in the first side wall 16 of the upper elongate channel section 12 and preferably abuts an opposing inner surface 46 of the second side wall 18—refer again to FIG. 5A. The elongate member 40 also passes through a registering pair of apertures 36 and 38 of the lower second elongate channel section 26—see FIGS. 2C and 5C.

Figure 5:
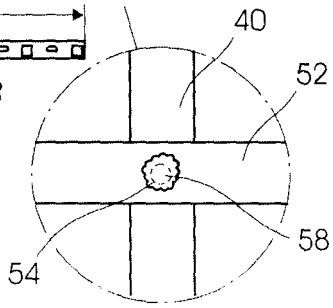

Two lengths 50 and 52 respectively of flat bar, which are spaced apart from one another and which are parallel to each other and to the first elongate channel section 12 and the second elongate channel section 26, extend across the elongate members 40. As is shown in an insert drawing to FIG. 5 each length 50, 52 of flat bar is predrilled with a plurality of holes 54 which are spaced apart from one another by the same distance as the spacing between adjacent vertical elongate members 40. Each length 50, 52 of flat bar overlies and is in contact with vertical side surfaces of the elongate members 40 and, due to the holes 54 which are centrally positioned on each elongate member, the components can easily be fixed together by means of puddle-welds 58 in each of the holes 54.

To retain the channel sections 12 and 26 in position the sections are lightly welded, e.g. tack-welded, to a number of the elongate members 40.

To enhance the resistance to attack of each elongate member 40 use is made of a number of briquettes 64 (FIG. 1) which are precast from an ultrahard ceramic, cementitious or other suitable composition and which have a square profile (cross-section) so that each briquette 64 can be inserted into an interior of a tubular elongate member 40. In order to retain the briquettes 64 in position, inside the tubular members 40, use is made of the technique shown in FIG. 2D in that a respective end cap 68 is attached, e.g. welded, to the lower end of each elongate member 40 to seal the open lower end thereof.

The grid structure 10 is heavy even though it has a relatively narrow width 70. An inspection of FIGS. 1 and 3 shows that, on the left side of the grid structure 10, the channel sections 12 and 26 and the flat bar lengths 50 and 52 project to the left beyond the leftmost elongate member 40A and form short stubs designated 12A, 26A, 50A and 52A respectively. These stubs overlap with a similarly constructed second grid structure 74 and allow the two grid structures 10, 74 to be interconnected in the manner shown in FIG. 6 which shows the structure 10 and a coplanar, similar adjacent structure 74. The adjacent stubs of the two coplanar structures overlap and are bolted or welded together.

Figure 6:
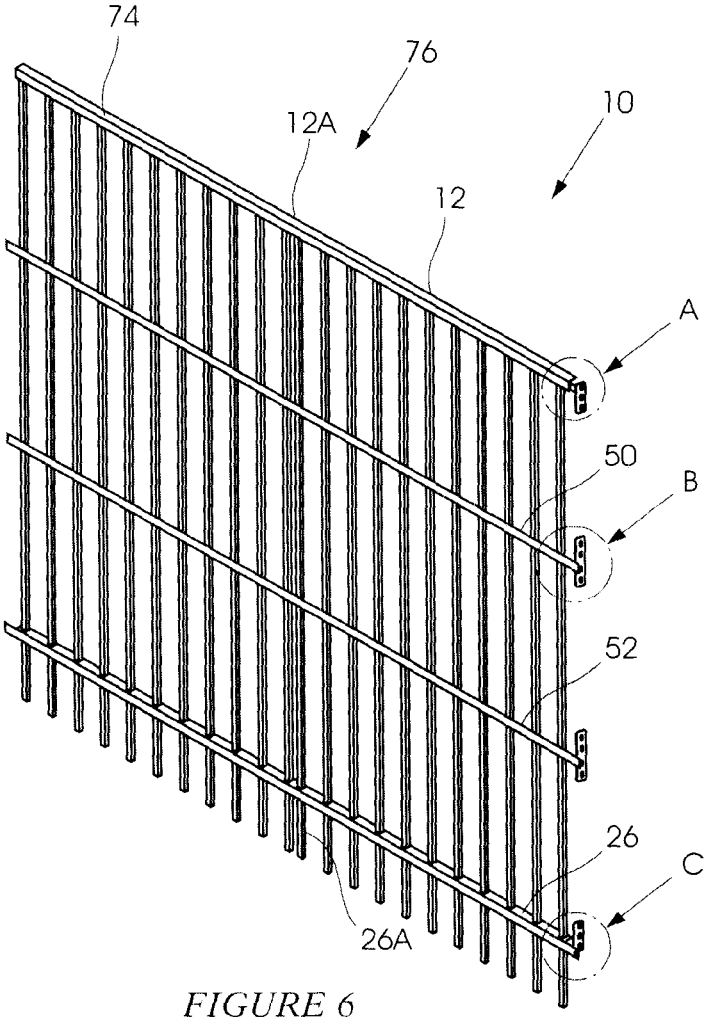
FIG. 6 illustrates in perspective a grid structure of enlarged width, FIGS. 7A, 7B and 7C respectively show on an enlarged scale constructional details of the grid structure in FIG. 6.
Figure 7A:
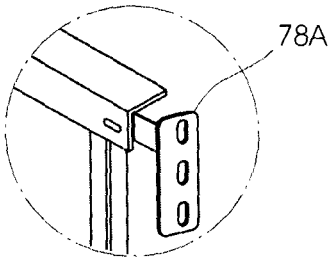
Figure 7B:
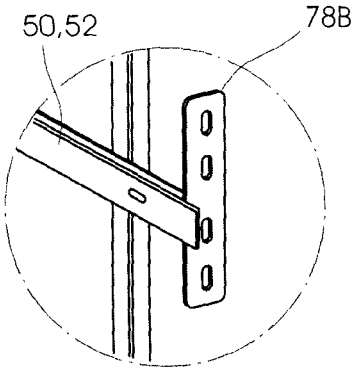
Figure 7C:
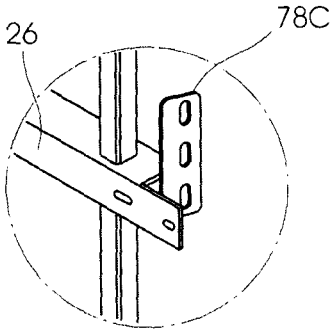

The resulting composite structure, shown in FIG. 6 and designated 76, has a width calculated to fit between two adjacent fence posts (not shown). Fasteners of the kind shown in FIGS. 7A, 7B and 7C are provided for this purpose. These Figures correspond to the circled portions in FIG. 6 which are marked with the letters A, B and C respectively. Reinforcing brackets 78A, 78B and 78C respectively are fixed to ends of the upper channel section 12, the flat bar lengths 50 and 52, and the lower channel section 26.

Figure 8:
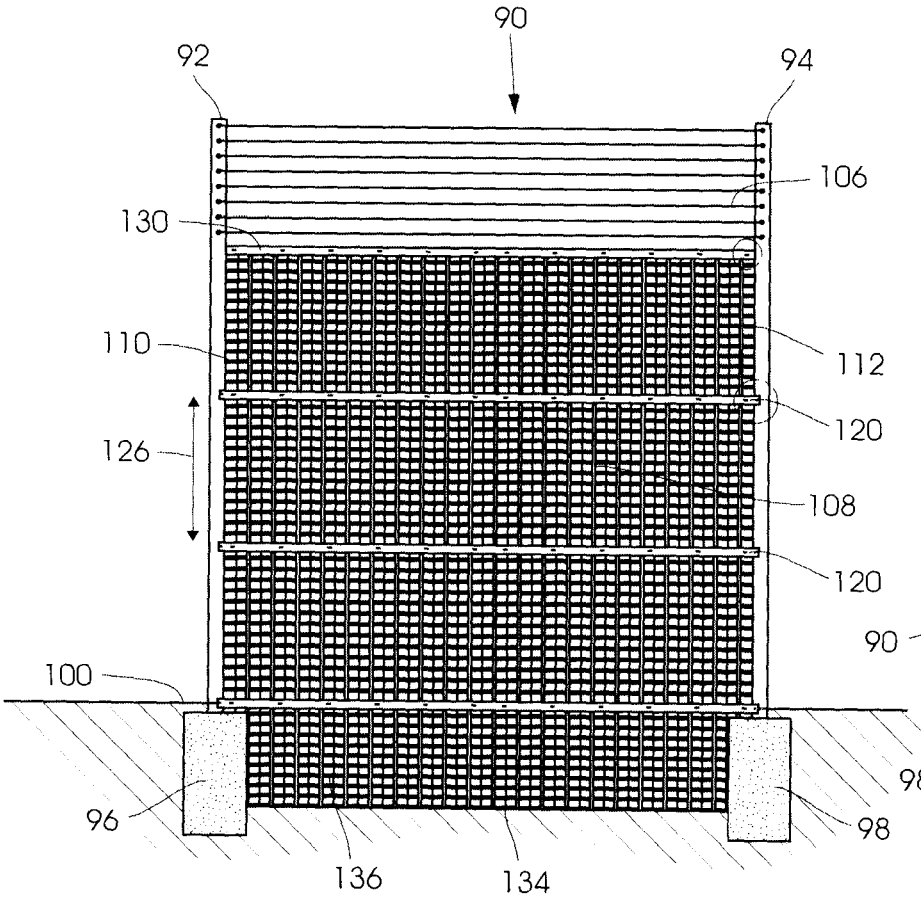
FIG. 8 is a view in elevation of a security panel which includes a security grid according to the invention.
Figure 9:
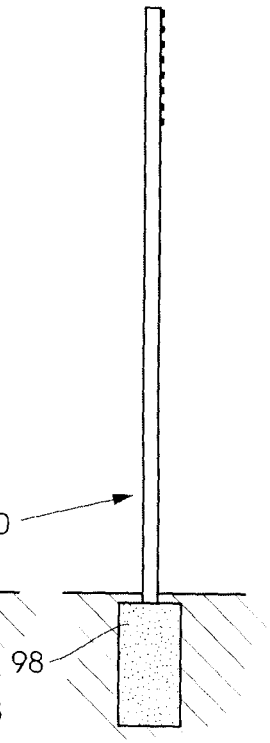
FIGS. 9 and 10 are end and plan views respectively of the security panel.
Figure 10:
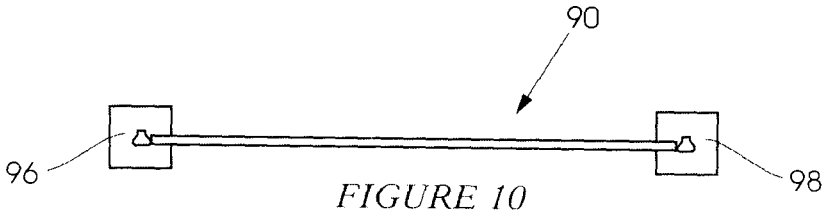
Figure 8A:
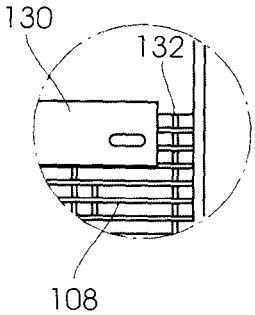
FIGS. 8A and 8B show on an enlarged scale constructional details of the security panel.
Figure 8B:
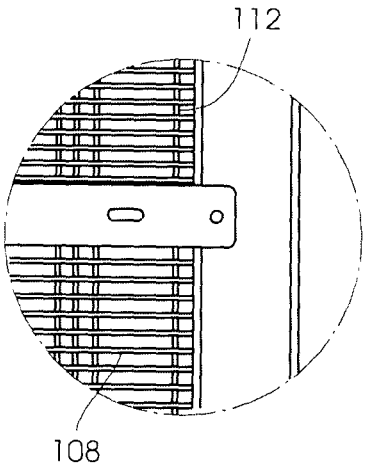

FIG. 8 shows a barrier panel 90 in elevation. FIG. 9 shows the barrier panel from one end and FIG. 10 shows the barrier panel from above. The barrier panel is positioned between and secured to two adjacent and spaced fence posts 92 and 94 respectively which, at lower ends, are embedded in concrete plinths 96 and 98. The ground level is designated 100. Razor wire or electrified strands 106 extend between upper ends of the posts above the barrier panel 90. The composite grid structure 76 shown in FIG. 6 is bolted to the posts 92, 94 using the respective reinforcing brackets 78A, 78B and 78C on each of the opposing sides of the grid structure. A high density mesh panel 108, positioned alongside the composite grid structure 76, has opposed vertical edges 110, 112 fixed to the posts 92 and 94 respectively. Flat bar lengths 120, spaced apart and parallel to one another, extend horizontally across the mesh panel. The flat bar lengths are fixed to the posts and are used to secure the mesh panel to the composite grid structure 76 at intervals spaced apart by a distance 126.

At an upper end, an angle iron length 130 covers an upper edge 132 of the mesh panel 108 and an adjacent upper surface of the upper channel section 12, and secures these components together.

The barrier panel 90 shown in FIG. 8 has formidable security characteristics. A primary benefit of the invention, however, lies in the manner of fabricating the grid structures which are incorporated in the barrier panel. The use of the channel sections 12, 26 with the apertures which are used to locate the vertically extending elongate members 40, eliminates a substantial number of welds. The elongate members 40 cannot be lifted upwardly because they are held captive by means of the upper channel section 12. The elongate members 40 cannot be moved downwardly because they abut the ground. A lower end 134 of the composite grid structure 76 can be embedded in the ground and use can also be made of anti-burrowing mesh 136, embedded in the ground, to restrict the likelihood that an intruder can go below the barrier.

Through the use of the construction technique described the grid structure 10 is fabricated using about 14 tack-welds and 14 puddle-welds (excluding the welds for the reinforcing brackets). This is to be compared with a total of at least 112 welds which are required using a conventional construction technique as described hereinbefore.

Prior to erection the grid structure is coated completely with a liquid polymer which is then allowed to set. The polymer hardens and ensures that the grid structure is bonded together and is rattle-proof. The polymer also provides resistance to corrosion.

The invention claimed is:

1. A security grid structure (10) comprising a first elongate channel section (12) which includes a first base (14) and first (16) and second (18) opposed side walls, wherein the first side wall (16) is formed with a plurality of spaced apart first apertures (20), a second elongate channel section (26) which is spaced from and parallel to the first elongate channel section, the second elongate channel section (26) including a second base (30) and third (32) and fourth (34) opposed side walls, wherein each of the third (32) and fourth (34) side walls is formed with a plurality of spaced apart second apertures (36, 38) and wherein the second apertures (36) in the third side wall (32) are in register with the respective second apertures (38) in the fourth side wall (34), a plurality of elongate members (40) which are parallel to and spaced apart from one another, each elongate member (40) respectively including a first end (42) and an opposed second end (44), wherein a portion of the elongate member at the first end (42) extends through a respective first aperture (20) in the first side wall (16) of the first elongate channel section (12) and said first end (42) abuts an opposing inner surface (46) of the second side wall (18), and wherein the elongate member (40) extends through a respective pair of registering second apertures in the second channel section (26) and a part of the elongate member is positioned between opposing surfaces of the third (32) and fourth (34) side walls, and at least one elongate element (50, 52) which is positioned between the first and second elongate channel sections (12, 26) and which extends transversely to, and which is secured to, the elongate members (40), said elongate element (50, 52) comprising a length of flat bar which is formed with a plurality of spaced apart holes (54) and which is positioned so that each hole (54) in the elongate element (50, 52) is in register with a respective elongate member 40 and wherein at each hole (54) the elongate element (50, 52) is puddle welded to the elongate member.

2. A security grid structure (10) according to claim 1 wherein each elongate member (40) is tubular.

3. A security grid structure (10) according to claim 2 wherein each elongate member (40) is filled with a ceramic material.

4. A security grid structure (10) according to claim 3 wherein the ultrahard ceramic material comprises a plurality of preformed briquettes (64).

5. A security grid structure (10) according to claim 3 wherein a respective end cap (68) is engaged with the second end (44) of each elongate member (40) to retain the briquettes (64) inside the elongate member.

6. A composite security structure (76) which includes at least two security grid structures (10), each of which is according to claim 1, which are coplanar and adjacent each other, and which are secured together and wherein each of the lengths of flat bar which respectively comprise the elongate elements (50, 52) of each of the at least two security grid structures (10) is formed with a plurality of spaced apart holes (54) and is positioned so that each hole (54) in the elongate element (50, 52) is in register with a respective elongate member (40) and wherein at each hole the elongate member (50, 52) is puddle welded to the elongate member (40).

7. A composite security structure (76) according to claim 6 wherein the at least two security grid structures (10) each includes at least two said elongate elements (50, 52), and wherein each elongate member (40) is tubular.

8. A composite security structure (76) according to claim 6 wherein each elongate member (40) is filled with a ceramic material.

9. A composite security structure (76) according to claim 8 wherein the ceramic material comprises a plurality of preformed briquettes (64).

10. A barrier panel (90) which comprises a grid structure which is located between and secured to two adjacent and spaced apart fence posts, wherein the grid structure includes at least one security grid structure (10) according to claim 1 a mesh panel (108) which is adjacent and alongside the security grid structure, and which has opposed vertical edges respectively fixed to the fence posts and at least two lengths of flat bar which are spaced apart and parallel to one another which extend horizontally across the mesh panel and which secure the mesh panel to the security grid structure.

11. The security grid structure of to claim 1 which is coated with a set liquid polymer.

* * * * *